US006830518B2

(12) United States Patent
Graskewicz

(10) Patent No.: US 6,830,518 B2
(45) Date of Patent: Dec. 14, 2004

(54) ADJUSTABLE GRIP BOWLING BALL KIT

(76) Inventor: Todd Michael Graskewicz, 15894 N. Franklin, Clinton Township, MI (US) 48038-1023

( * ) Notice: Subject to any disclaimer, the term of this patent is extended or adjusted under 35 U.S.C. 154(b) by 0 days.

(21) Appl. No.: 10/122,670

(22) Filed: Apr. 15, 2002

(65) Prior Publication Data

US 2003/0195051 A1 Oct. 16, 2003

(51) Int. Cl.[7] ..... A63B 37/00
(52) U.S. Cl. ..... 473/130; 473/129
(58) Field of Search ..... 473/125, 127, 473/128, 129, 130; 403/348, 349

(56) References Cited

U.S. PATENT DOCUMENTS

| | | | | |
|---|---|---|---|---|
| 3,102,725 A | * | 9/1963 | Jarus | 473/130 |
| 3,129,002 A | | 4/1964 | Bednash | |
| 4,247,102 A | | 1/1981 | Seyler | |
| 4,561,654 A | * | 12/1985 | Haza | 473/129 |
| 4,892,308 A | * | 1/1990 | Gaunt | 473/129 |
| 4,968,033 A | | 11/1990 | Aluotto | |
| 5,118,106 A | * | 6/1992 | Goldman | 473/129 |
| 5,186,197 A | * | 2/1993 | Lavine | 135/25.4 |
| 5,505,666 A | | 4/1996 | Arsenault | |
| 5,738,592 A | * | 4/1998 | Saunders | 473/130 |
| 5,741,084 A | * | 4/1998 | Del Rio et al. | 403/349 |
| 5,800,276 A | | 9/1998 | Hill | |
| 6,003,724 A | * | 12/1999 | Collins et al. | 221/154 |
| 6,126,553 A | | 10/2000 | Lakusiewicz | |
| 6,280,343 B1 | | 8/2001 | Scheid et al. | |

OTHER PUBLICATIONS

Exhibit A—Sheets 1–8; Sizing Instrument for a Bowling Ball Thumb Hole. Digital photographs of Prior Art circa 1960 showing a set of thumb measurement inserts for selective thumb–size measurement, which can be inserted into a bowling ball–like measurement device for subsequent sizing of a bowler's hand span.

* cited by examiner

*Primary Examiner*—William M. Pierce
(74) *Attorney, Agent, or Firm*—Brooks Kushman P.C.

(57) ABSTRACT

An adjustable grip bowling ball kit comprising a tubular sleeve member adapted for permanent insertion into a bowling ball grip hole and a plurality of inserts to be removably inserted into the sleeve is provided. The sleeve is further equipped with at least one guide member extending from a sleeve inner diameter surface into the sleeve's interior. Each insert has an outer diameter surface and an inner diameter surface. Each insert is further equipped with at least one channel groove extending along the outer diameter surface of the insert. Each channel groove is adapted to cooperatively engage the guide member upon insertion of the insert into the sleeve. Upon insertion, rotation of the insert in one direction locks the insert within the sleeve. Rotation of the insert in another direction unlocks the insert to facilitate easy removal of the insert from the sleeve.

4 Claims, 3 Drawing Sheets

Fig-3
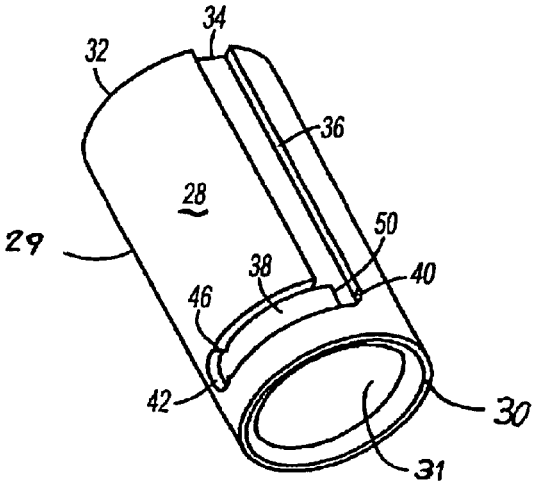
Fig-4
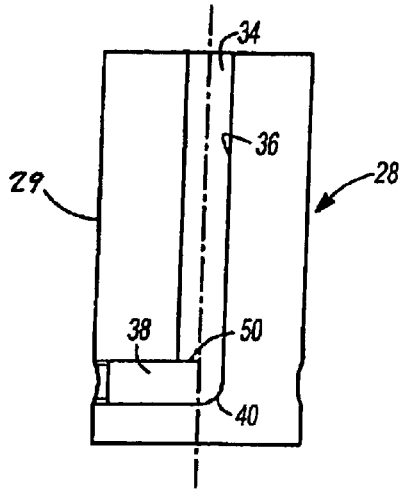
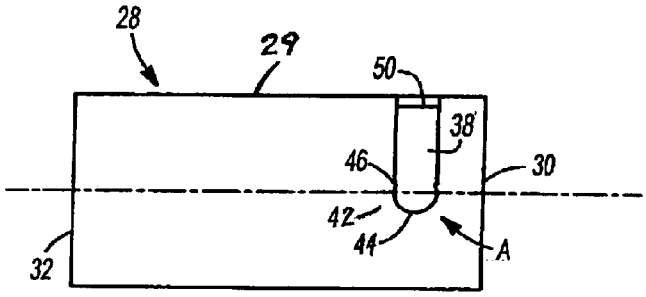
Fig-5
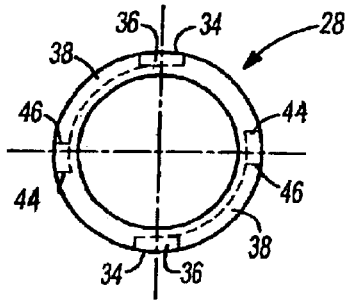
Fig-6
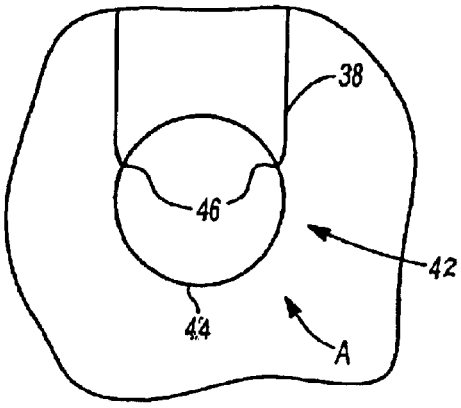
Fig-7

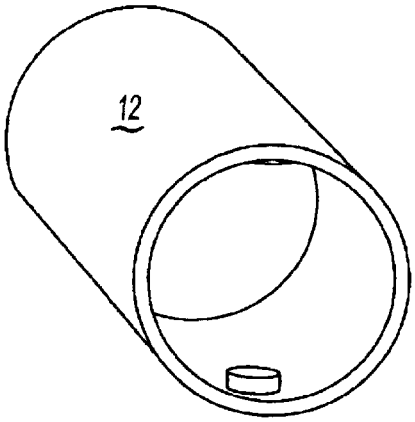
Fig-8
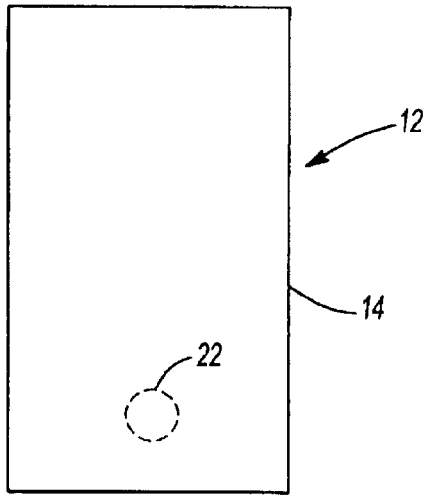
Fig-9
Fig-10
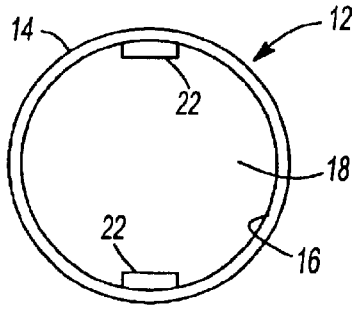

ADJUSTABLE GRIP BOWLING BALL KIT

BACKGROUND OF THE INVENTION

1. Field of the Invention

The present invention relates to an adjustable grip bowling ball kit to allow a player to custom fit any bowling ball to his/her personal grip and feel, and to provide a way to allow the player to vary the grip during the play of the game to suit lane conditions and to accommodate variability of the player's fingers and hand size during the game.

2. Description of the Related Art

Goldman, U.S. Pat. No. 5,118,106 is directed to an adjustable aid kit for a bowling ball having a thumb sleeve and a pair of finger sleeves. The sleeves are permanently mounted into a bowling ball grip hole. The sleeves are equipped with a threaded portion at their distal ends. The inserts are also threaded at their distal ends and equipped with a key configuration (i.e., notches) at their proximal ends. When the insert is inserted into the sleeve, a key tool is used to thread the insert into the sleeve thereby holding it in place. When it is desired to change the grip of the ball, the key is used to unthread the insert and insert a new insert.

Goldman '106 differs from the instant invention. The present invention does not use a sleeve that is threaded at its distal end to threadably engage a threaded insert to retain the insert in place in the sleeve. Rather, the instant invention is directed to an adjustable grip bowling ball kit that has guide member located along the inner diameter surface of the sleeve. Each insert has a distal end and a proximal end and each insert is further equipped with at least one channel groove extending along the outer diameter surface of the insert. Each channel groove is adapted to cooperatively engage the guide member of the tubular sleeve upon insertion of said insert into said sleeve member. Each channel groove terminates in a guide retention member whereby rotation of the insert in the tubular sleeve member in one direction causes the guide member to cooperatively engage said guide retention member to secure the insert within said tubular sleeve member. Rotation of the insert in another direction causes the guide member to disengage the guide retention member to facilitate easy removal of the insert from the tubular sleeve member. Accordingly, the present invention differs from Goldman '106.

Seyler U.S. Pat. No. 4,247,102 is directed to a removable interchangeable thumb or finger grip insert for the thumb or finger hole of a bowling ball. The insert is generally cylindrical and hollow and is formed with a slotted resilient hollow bottom slotted and threaded for insertion to a threaded drilled hole in a bowling ball using a tool to thread the insert into the hole.

The present invention does not use threaded inserts and does not rely upon tools to insert the finger grips into the bowling ball holes. Accordingly, the present invention differs from Seyler '102.

Scheid et al. U.S. Pat. No. 6,280,343 B1 is directed to a method of adapting a relatively small number of bowling balls for use in testing by a relatively large number of bowlers having different hand sizes. The method consists of pre-drilling a number of grip holes and inserting removable inserts therein that are configured to fit a bowler. To achieve this, a hole is counterbored into the existing holes in the ball and a section of PVC tube is cut to length. The tube is then threaded internally and adhered into place into the hole. Externally threaded inserts are then threaded into place in the PVC sleeve, as needed to fit the bowler's grip.

The present invention does not use threaded inserts and threaded sleeves to achieve the adjustable kits of the instant invention. Accordingly, the present invention differs from Scheid et. al. '343.

Lakusiewicz, U.S. Pat. No. 6,126,553 is directed to a finger insert in a bowling ball to accommodate a bowler's fingers through all conditions of play and variability experienced during a game. Interchangeability of the various sizes of inserts is accomplished in part by using a small, end threaded cylindrical rod that screws into a centrally and correspondingly threaded plate in the bottom end of the insert, allowing the bowler to fit one size insert and replace it with another insert of different size of the same anatomical configuration. The self locking mechanism includes at least one projection which is formed integrally with the external surface of the ball hole and extend from any point on the external cylindrical surface of the insert below the level of the ball surface. The insert side extension produces a self locking or detenting function by interfacing with a groove of an appropriately corresponding size and shape formed, as by example, routing into the inner wall of a predrilled ball. The locked insert is released automatically when the groove projection interface is separated by the action of a second rod that is wedged shaped.

The present invention does not utilize a locking mechanism formed by routing the sidewall of a predrilled hole in the ball. In addition, no tools are necessary to remove the inserts of the present invention and replace them with other more desired inserts to facilitate the finger variability of a bowler.

It is a chronic problem for bowlers that during the progress of a game, the size of their fingers change, thereby resulting in poor fit of the ball and corresponding loss of ball control or injury to the fingers. The solution had been to properly fit the ball to the bowler, or for the bowler to have a number of bowling balls with different sized holes. This results in expense and uncertainty for the bowler, as he/she is unsure which bowling ball to use, and whether they have the right bowling ball for the condition their fingers have assumed because of temperature, humidity or personal physiology such as water retention.

These and other problems in the art have been met by the instant invention as a reading of the specification and claims that follow will show.

SUMMARY OF THE INVENTION

The present invention is directed to an adjustable grip bowling ball kit, comprising in one embodiment a tubular sleeve member adapted for permanent insertion into a bowling ball grip hole. The tubular sleeve member has a sleeve outer diameter surface to define an exterior of the tubular sleeve member, and a sleeve inner diameter surface to define a sleeve interior. The tubular sleeve member is further equipped with at least one guide member extending from said sleeve inner diameter surface into the sleeve interior.

The kit further includes a plurality of rotatably interchangeable inserts adapted to be coaxially received in the tubular sleeve member and removed therefrom. Each insert has an insert outer diameter surface to define an exterior of the insert and an insert inner diameter surface to define an insert interior. The insert outer diameter surface of each insert is of smaller diameter than said sleeve inner diameter surface. Each insert has a wall thickness that is defined by the radial distance separating the insert outer diameter surface and the insert inner diameter surface. Each insert has a distal end and a proximal end and each insert is further equipped with at least one channel groove extending along the insert outer diameter surface. Each channel groove is adapted to cooperatively engage the guide members of the tubular sleeve member upon insertion of said insert into said tubular sleeve member. Each channel groove terminates in a guide retention member whereby rotation of the insert in the tubular sleeve member in one direction causes the guide member to cooperatively engage said guide retention member to secure the insert within said tubular sleeve member. Rotation of the insert in another direction causes the guide member to disengage the guide retention member to facilitate easy removal of the insert from the tubular sleeve member.

In another embodiment, the invention is directed to an adjustable grip bowling ball kit, comprising a tubular sleeve member adapted for permanent insertion into a bowling ball grip hole. The tubular sleeve member has a sleeve outer diameter surface to define an exterior of said tubular sleeve member, and a sleeve inner diameter surface to define an interior of said tubular sleeve member. The tubular sleeve member is further equipped with at least one guide member extending from said sleeve inner diameter surface into said interior of said tubular sleeve member.

The kit further includes a plurality of rotatably interchangeable inserts adapted to be coaxially received in said tubular sleeve member and removed therefrom. Each insert has an insert outer diameter surface to define an exterior of the insert and an insert inner diameter surface to define an interior of each insert. The insert outer diameter surface of each insert is of smaller diameter than said sleeve inner diameter surface of the tubular sleeve member. Each insert has a distal end and a proximal end. Each insert is further equipped with at least one longitudinal channel groove extending longitudinally along the insert outer diameter surface of each insert from the distal end. Each longitudinal channel groove is adapted to cooperatively engage the guide member of the tubular sleeve upon insertion of the distal end of the insert into the tubular sleeve member. Each longitudinal channel groove terminates in a circumferential channel groove near the insert proximal end. The circumferential channel groove extends circumferentially along the insert outer diameter surface and terminates in a guide retention member. The guide retention member comprises a circular portion adjacent a detent. Each circumferential channel groove is likewise adapted to cooperatively engage the guide member. The dent is provided adjacent the circular portion to facilitate securement of the guide member in the guide retention member of the circumferential channel groove. The longitudinal and circumferential channel grooves having a depth extending only partially into the wall thickness of the insert. Insertion of the insert causes the guide member to cooperatively engage said longitudinal groove. Upon complete insertion of said insert, rotation of the insert in the tubular sleeve member in one direction causes the guide member to cooperatively engage the circumferential channel groove and terminate in the guide retention member, which secures the insert within said tubular sleeve member. Rotation of the insert in another direction causes the guide member to disengage the guide retention member to facilitate easy removal of the insert from the tubular sleeve member.

It is further contemplated that the kit include two opposed guide members on the tubular sleeve member, and two opposed longitudinal channel grooves and circumferential channel grooves on said insert outer diameter surface. Upon securing of the insert into the tubular sleeve member, it may be beveled to provide for a custom fit for the player.

Finally, it is contemplated that the detent facilitates the securement of the insert in the tubular sleeve member without the need for a spring axially biasing the insert within the tubular sleeve member. Additionally, the insert can be removed without the need for a key configuration formed in the proximal end of the insert for use in combination with a key tool.

BRIEF DESCRIPTION OF THE DRAWINGS

FIG. 3 is a detailed perspective view of the insert member of the adjustable kit as shown in FIG. 2.

FIG. 4 is an on side view of the insert member of FIG. 3.

FIG. 5 is an on side view of the insert member of FIG. 3.

FIG. 6 is an end view of the insert member of FIG. 3 showing its circular profile.

FIG. 7 is a detailed view of circle A of FIG. 5, showing the detent lock.

FIG. 8 is a perspective view of the tubular sleeve member of the adjustable grip kit of FIG. 1.

FIG. 9 is a side view of the tubular sleeve member of FIG. 8.

FIG. 10 is a side view of the tubular sleeve member of FIG. 8, showing its circular profile.

DETAILED DESCRIPTION OF THE PREFERRED EMBODIMENT(S)

Figure 1:
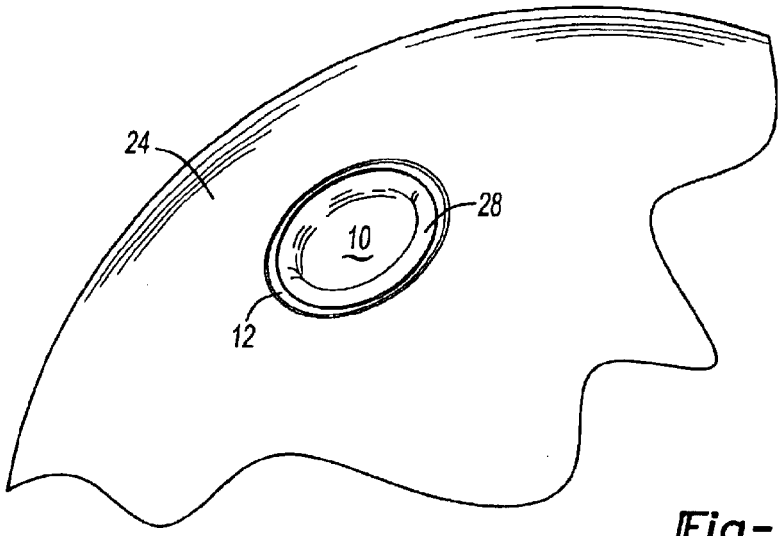
FIG. 1 is a perspective view of a bowling ball with one hole fitted with the adjustable grip kit of the present invention.
Figure 2:
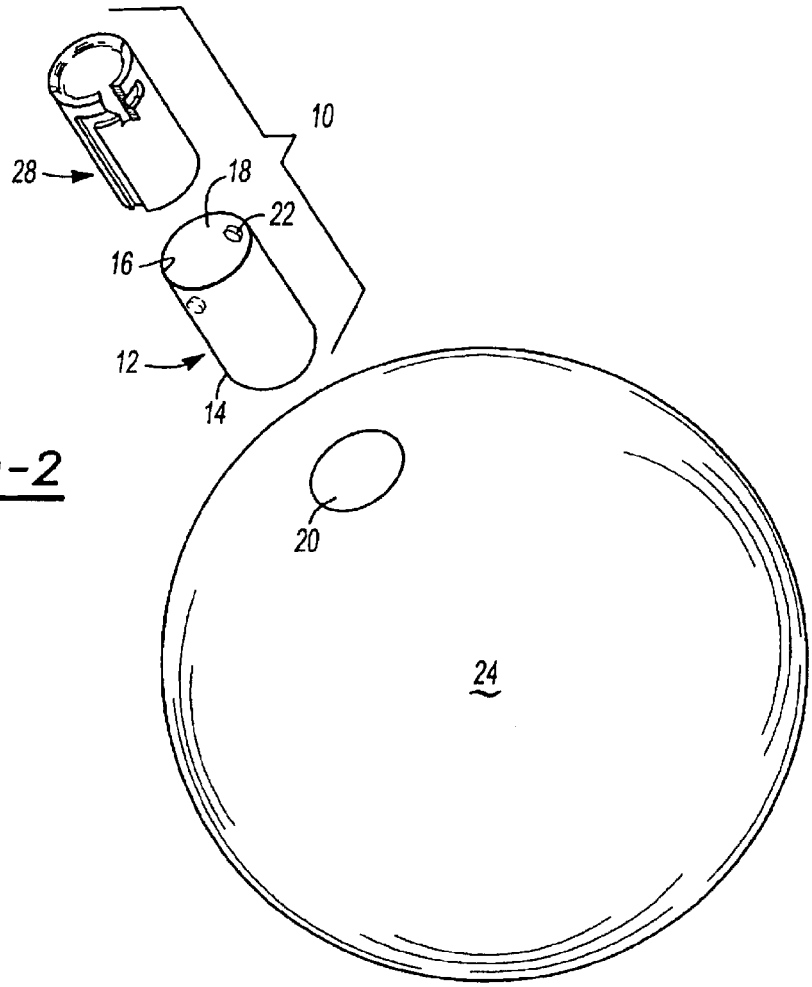
FIG. 2 is a exploded perspective view of the adjustable grip kit.

Turning now to the drawings wherein like numerals refer to like structures, and particularly to FIGS. 1 and 2, there is shown therein the adjustable grip kit 10 of the present invention prepared for insertion into a pre-drilled or custom drilled hole 20 of a bowling ball 24. As seen in FIGS. 2 through 10, kit 10 is comprised of a tubular sleeve member 12 that has a sleeve outer diameter surface 14 and a sleeve inner diameter surface 16, that defines a sleeve interior 18. The tubular sleeve member 12 has an outer diameter that is less than the diameter of the hole 20 in the bowling ball 24. In the interior of the tubular sleeve member 12, a guide member 22 projects from the sleeve inner diameter surface 16 into the sleeve interior 18. While the tubular sleeve member 12 will be operable with one such guide member 22, it is contemplated that two opposed guide members may be used, or in the alternative that a plurality of guide members may be employed in a manner to be hereinafter described. The tubular sleeve member 12 is adapted to be inserted into the hole 20 of the bowling ball 24 and may be secured in place by member of an adhesive, such as methyl methacrylate or some other acrylate adhesive to fix a permanent bond between the bowling ball 24 and the tubular sleeve member 12. When inserting the tubular sleeve member 12 into the hole 20 in the bowling ball 24, it will be understood that the tubular sleeve member 12 is of such length that it will not extend beyond the surface of the bowling ball 24. It may also be necessary to drill the pre-existing hole 20 for the bowler's grip a larger size to accommodate the tubular sleeve member 12. The guide member 22 may be a cylindrical projection, as depicted, or may even be a ball bearing capable of being snap fit into place in the sleeve inner diameter surface 16. Those skilled in the art will understand that many guide member means are possible, and all of them are included in the description set forth herein. Moreover, although the guide member 22 is shown at the proximal end of the sleeve, it is possible that the guide member 22 may be located anywhere along the sleeve inner diameter surface 16.

Turning to FIGS. 3 through 7, a rotatably interchangeable insert 28 has a proximal end 30 and a distal end 32. The insert 28 is cylindrical or tubular in shape, and has an insert outer diameter surface 29 and an insert inner diameter surface 31, the radial distance therebetween determining a wall thickness of the insert 28. The insert 28 is adapted to be inserted coaxially with the tubular sleeve member 12 in a manner to be hereafter described. It will be appreciated by those skilled in the art that the proximal end 30 may be beveled to facilitate comfort and ease of use in the manner customary for beveling grip holes in bowling balls.

The insert 28 member has a channel groove 34 that begins at the distal end 32 of the insert 28 and extend some length of the insert 28 to close proximity to the proximal end 30. As depicted herein, the channel groove 34 is configured to cooperatively engage the guide member 22 when the distal end 32 of the insert 28 is fit within the tubular sleeve member 12. Preferably, the channel groove 34 has a depth which extends only partially from the insert outer diameter surface 29 inward into the wall thickness of the insert 28 as shown in FIG. 6. While one embodiment of the channel groove 34 is shown in the drawings, those skilled in the art recognize that many different configurations for the channel groove 34 are possible to effect the purposes of the present invention.

Channel groove 34 include both a longitudinal channel groove 36 and a circumferential channel groove 38. The longitudinal channel 36 extends from the distal end 32 some length longitudinally along the insert outer diameter surface 29. Near the proximal end 30, the longitudinal channel groove 36 meets the circumferential channel groove 38 extending some distance circumferentially near the proximal end 30 of the insert 28. The circumferential channel groove 38 intersects the longitudinal channel groove 36 at an intersection 40 and terminates in a guide retention member 42.

Turning to FIGS. 5 and 7, guide retention member 42 is comprised of a circular portion and a snap fit detent 46. The snap fit detent 46 is formed adjacent the circular portion 44 of the circumferential channel groove 38. The circular portion 44 is of the same diameter as the channel groove 34, but is circular so that the detent 46 forms an integral part of the guide retention member 42 and the circumferential channel groove 38. It is contemplated that the insert 28 is formed of a material such as PVC or some other hard plastic material such that it is capable of some resilience to allow the guide member 22 to pass beyond the detent 46 and snap into place in the circular portion 44 thereby locking the guide member 22 into the guide retention member 42 and securing the insert 28 into the tubular sleeve member 12. Once the insert 28 is secured into the tubular sleeve member 12, it is provided with an area which is adapted to be beveled to custom fit the ball to the user.

In operation, the tubular sleeve member 12 is glued into the predrilled hole 20 in the bowling ball 24. An insert 28 is selected that conforms to the diameter of the player's digit(s). The insert 28 is fitted into the tubular sleeve member 12, distal end 32 first. Insertion of the insert 28 causes the channel groove 34 to cooperatively engage the guide member 22 and ensure coaxial insertion of the insert 28 into the tubular sleeve member 12. When the insert 28 is completely inserted into the tubular sleeve member 12, the guide member 22 will travel up the longitudinal channel groove 36, and end at the intersection 40. The player then inserts his/her digit into the insert 28, and a turning motion of the digit within the insert 28 will cause the insert 28 to rotate. The rotation of the insert 28 causes the guide member 22 to travel along the circumferential channel groove 38, and terminate with a snap fit past the detent 46 into the circular portion 44 of the guide retention member 42. When it is desired to remove the insert 28, the player inserts his/her digit, rotates the insert 28 in opposite direction, and the guide member 22 is released from the guide retention member 42 allowing the guide member 22 to travel along the circumferential channel groove 38 to the longitudinal channel groove 36 where the player then extracts the insert 28.

Although several embodiments are described herein, those skilled in the art will recognize that many variations of this invention will become apparent to those skilled in the art without departing from the scope and spirit of the invention as set forth in the appended claims.

I claim:

1. An adjustable grip bowling ball kit, comprising:

a tubular sleeve member adapted for permanent insertion into a bowling ball grip hole, said tubular sleeve member having a sleeve outer diameter surface and a sleeve inner diameter surface, the sleeve inner diameter surface defining a sleeve interior said tubular sleeve member further equipped with at least one guide member extending from said sleeve inner diameter surface into said sleeve interior;

a plurality of rotatably interchangeable inserts adapted to be coaxially received in said tubular sleeve member and removed therefrom, each said insert having an insert outer diameter surface and an insert inner diameter surface, the insert inner diameter surface defining an insert interior, said insert outer diameter surface of each said insert of smaller diameter than said sleeve inner diameter surface, each said insert having a wall thickness defined by the radial distance between the insert outer diameter surface and the insert inner diameter surface, each said insert having a distal end and a proximal end;

each said insert further equipped with at least one longitudinal channel groove extending longitudinally along the insert outer diameter surface from said distal end, said longitudinal channel groove adapted to receive said guide member of said tubular sleeve member upon insertion of said distal end of said insert into said tubular sleeve member, said longitudinal channel groove terminating in a circumferential channel groove near said insert proximal end, said circumferential channel groove extending circumferentially along said insert outer diameter surface and terminating in a guide retention member, the guide retention member having a circular portion adjacent a detent, said circumferential channel groove adapted to receive said guide member, said longitudinal and circumferential channel grooves having a depth extending only partially into the wall thickness of said insert;

wherein insertion of the insert causes the guide member to cooperatively engage said longitudinal channel groove, upon complete insertion of said insert, rotation of said insert in the tubular sleeve member in one direction causes the guide member to cooperatively engage said circumferential channel groove, upon complete rotation of said insert, the guide member engages said guide retention member, said insert being rotated with sufficient force to allow the guide member to pass beyond the detent and lock into place in the circular portion securing the insert within said tubular sleeve member, upon rotation of the insert in an opposite direction, the guide member disengages from the guide retention member, said insert being rotated with sufficient force to allow the guide member to pass beyond the detent into the circumferential channel groove to facilitate easy removal of the insert from the tubular sleeve member.

2. The adjustable bowling ball grip of claim 1, further including two opposed guide members on said tubular sleeve member, and two opposed longitudinal channel grooves and circumferential channel grooves on said insert outer diameter surface.

3. The adjustable bowling ball grip of claim 1, wherein the detent facilitates securement of the insert within the tubular sleeve member absent the use need of a spring axially biasing the insert within the tubular sleeve member.

4. The adjustable bowling ball grip of claim 1, wherein cooperation of said insert within the tubular sleeve member is permitted absent the need for a key configuration formed in the proximal end of said insert for use in combination with a key tool.

* * * * *